US007004851B2

(12) United States Patent
Pierce

(10) Patent No.: US 7,004,851 B2
(45) Date of Patent: Feb. 28, 2006

(54) GOLF TRAINING AID

(76) Inventor: Riley G. Pierce, 4209 Arbor Gate, Fort Worth, TX (US) 76133

( * ) Notice: Subject to any disclaimer, the term of this patent is extended or adjusted under 35 U.S.C. 154(b) by 0 days.

(21) Appl. No.: 11/122,040

(22) Filed: May 5, 2005

(65) Prior Publication Data

US 2005/0282651 A1 Dec. 22, 2005

Related U.S. Application Data

(60) Provisional application No. 60/580,252, filed on Jun. 17, 2004.

(51) Int. Cl.
*A63B 69/36* (2006.01)

(52) U.S. Cl. ..... 473/261; 473/257

(58) Field of Classification Search ..... 473/257–268, 473/279, 273

See application file for complete search history.

(56) References Cited

U.S. PATENT DOCUMENTS 3,885,796 A 5/1975 King
5,282,627 A 2/1994 Beck
5,503,395 A * 4/1996 Cook ..... 473/261
5,527,041 A * 6/1996 Terry et al. ..... 473/150
5,776,007 A * 7/1998 Kendall et al. ..... 473/258
6,019,685 A * 2/2000 Fonseca et al. ..... 473/265
6,443,852 B1 * 9/2002 Kim ..... 473/265
6,669,574 B1 12/2003 Riley et al.

* cited by examiner

*Primary Examiner*—Nini F. Legesse
(74) *Attorney, Agent, or Firm*—Richard C. Litman

(57) ABSTRACT

A golf training aid for improving putting stroke and stance is transparent plastic in the shape of a tunnel, the bottom being open for placement on grass or carpet. A guide slot is formed by a rectilinear guide slot housing centrally disposed along the length of the upper wall and extending forward from the entrance opening, forming a neck. A black or opaque strip of plastic forms an extendable guide bar slidingly fitting within the guide slot. The extendable guide bar may be pulled forward a desired distance so as to increase the effective length of the device. Parallel opaque stripes are located along the length of the upper wall and spaced the diameter of a golf cup. The golfer evaluates putting stroke and ball travel relative to the guide bar and stripes.

9 Claims, 8 Drawing Sheets

GOLF TRAINING AID

CROSS-REFERENCE TO RELATED APPLICATION

This application claims the benefit of U.S. Provisional Patent Application Ser. No. 60/580,252, filed Jun. 17, 2004.

BACKGROUND OF THE INVENTION

1. Field of the Invention

The present invention relates to golf training aids. More particularly, the present invention relates to a device for use in improving a golfer's putting stroke and stance.

2. Description of the Related Art

The use of devices to show alignment of the club and the direction of ball travel through a putting stroke and subsequent travel of the ball during the practice of the putting stroke is known. It is desirable that the putting swing maintain the club head straight and square to the ball and the intended direction of ball travel. It is also desirable to hit the ball squarely so that it does not curve away from the desired path. Known alignment devices train the golfer to maintain the putting head of the club square through the stroke by providing alignment walls or guides suck that the golfer becomes aware of an off-line stroke by hitting the alignment walls. Also, guide lines are provided to determine if the ball follows the intended straight line. These devices are not effective in showing the golfer the travel path of his hands on the golf grip. Also, the golfer's immediate attention is required in following the path of the ball. It would be desirable to provide a device in which the travel of the golfer's hand and club head may be easily monitored relative to the target path, while any deviation from the target path of the ball after the stroke becomes apparent.

U.S. Pat. No. 5,282,627, issued Feb. 1, 1994, to Beck, describes a putting trainer for improving the putting stroke of golfers having integrally formed, upright, opposing walls and a bottom wall. The opposing sidewalls are extended and inwardly curved to guide a putter head during practice swings. Longitudinal and latitudinal lines are disposed on the surface of the bottom wall to guide the golfer in aligning the putter head before, during and after the swing.

U.S. Pat. No. 3,885,796, to King, V. W., describes a golf putting practice apparatus having opposing upright sidewalls, which are attached to a horizontal base. A black strip is disposed centrally and along the length of the base, the strip being an adhesive type strip or black paint applied thereon.

U.S. Pat. No. 6,669,574 B1, issued Dec. 30, 2003, to Riley et al., describes a U-shaped golf training device with guidelines disposed down its center and along its length such that a user can visually identify strike alignment with respect to the path of the ball. Width adjustments are provided to fit a variety of putter heads. A buzzer sounds when the putter head brushes against either of the sidewalls warning the golfer of a crooked putter stroke.

None of the above inventions and patents, taken either singly or in combination, is seen to describe the instant invention as claimed. Thus a golf training aid solving the aforementioned problems is desired.

SUMMARY OF THE INVENTION

The golf training aid of the present invention is an apparatus for teaching or enhancing a golfer's putting stroke and stance. The device is constructed from a transparent plastic material in the general shape of a tunnel having upright sidewalls and a flat upper wall. The bottom is open and the device may be used on any desired surface, such as carpet or grass. The device has a generally rectangular entrance opening, the sidewalls being parallel and the outlet having the same dimensions as the entrance opening, the upper wall remaining at a constant height.

A black or opaque strip of plastic forms an extendable guide bar slidingly fitting within a guide slot. The guide slot is formed by a rectilinear guide slot housing centrally disposed along the length of the upper wall and extending forward from the entrance opening, forming a neck. The extendable guide bar is the same length as the guide slot housing, including the neck, and may be pulled forward a desired distance so as to lengthen the putt to be practiced with the training aid. The extendable guide bar is about 1" in width, allowing a portion of a standard golf ball to be seen on each side of the bar when observed from above. The housing has two parallel black or opaque stripes along the length of the upper wall, each being parallel to and spaced on opposite sides of the guide slot housing.

In use, the ball is placed beneath the extendable guide bar for use. The golfer's body and feet are placed in alignment, and the putter faced placed in a square formation with the path. During the stroke, the putter head passes under the extendable guide bar, showing the location of the golfer's hand and clubface as related to the target path beneath the extendable guide bar. In this way, the golfer not only gets instant feedback as to the position of the clubface in relation to the anticipated path, but also views the hand position relative thereto. The ball becomes clearly visible if it deviates from the target path. The overall length of the housing and neck is about 2 feet and the extendable guide bar may be extended forward another foot, lengthening of the practice putt path to 3 feet, a preferred distance for perfecting the putting stroke. The device may be made in a longer version if a longer target path is desired.

In another embodiment, a guide bar is placed in an open slot formed on top of the housing. The guide bar and slot have mating hook and loop material which allows repositioning of the bar for different length putts, while maintaining the bar in a fixed position during use. The guide bar is preferably about twice the length of the tunnel-like housing.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a golf training aid for teaching or enhancing a golfer's putting stroke and stance. The device is transparent plastic having the general shape of a tunnel, the bottom being open for placement on grass or carpet. A black or opaque strip of plastic forms an extendable guide bar slidingly fitting within a guide slot. The guide slot is formed by a rectilinear guide slot housing centrally disposed along the length of the upper wall and extending forward from the entrance opening, forming a neck. The extendable guide bar is the same length as the guide slot housing, including the neck, and may be pulled forward a desired distance so as to increase the effective length of the device. The golfer may easily gauge the stroke by watching the putter head and gripping hand movement relative to the guide bar and see the results of the stroke as the ball deviates from the target path beneath the guide bar and becomes fully visible within the transparent tunnel. In another embodiment, an open slot replaces the guide slot housing and the guide bar is placed at a desired location for a particular length of putt as more fully described below.

Figure 1:
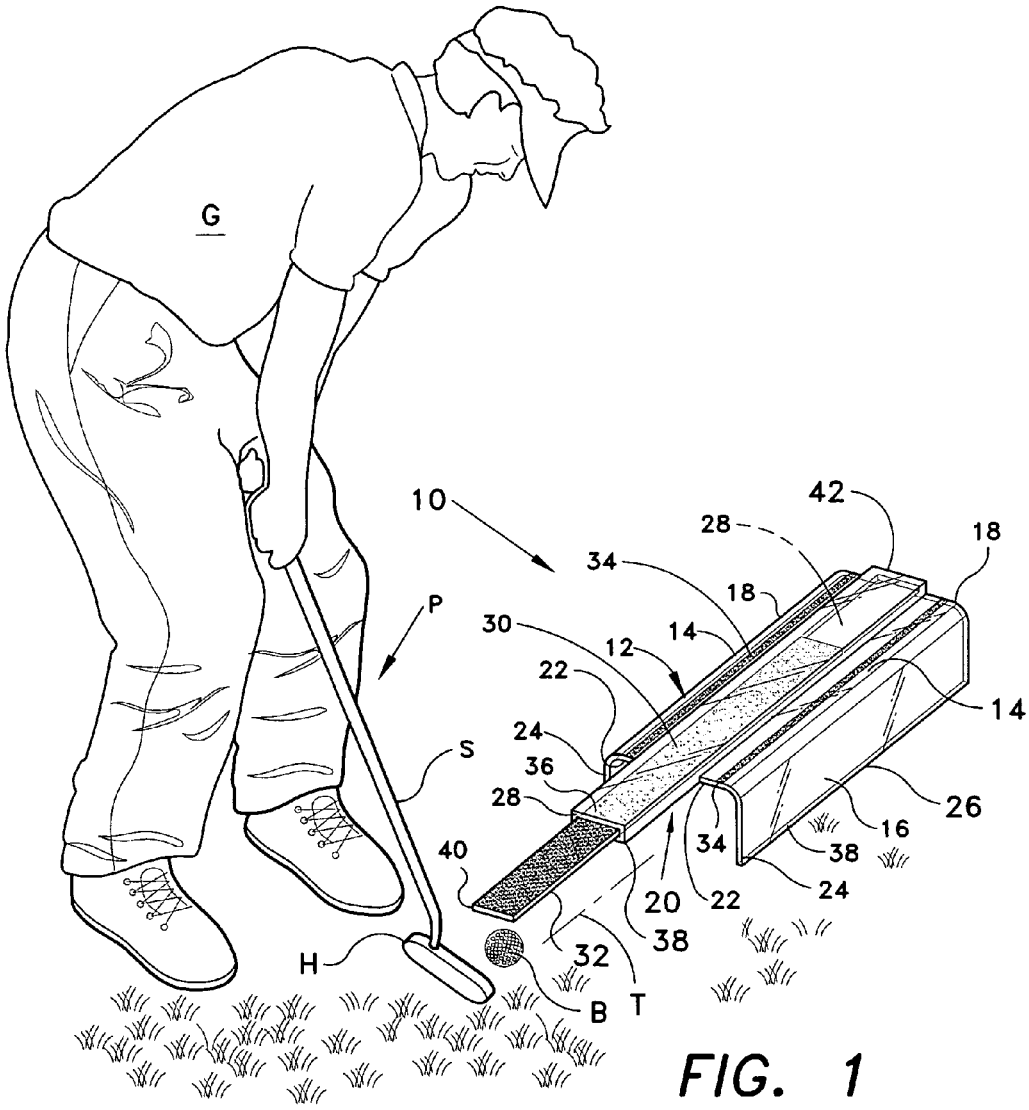
FIG. 1 is an environmental, perspective view of a golf training aid according to the present invention.

Referring to FIG. 1, there is shown an environmental perspective view of the golf training aid of the present invention, referred to as element number 10 and which is located on a grassy surface. A golf ball B is placed along the target path T and a golfer G is lined up to putt ball B into the housing 12 of training aid 10 with putter P having shaft S and putter head H.

Figure 2:
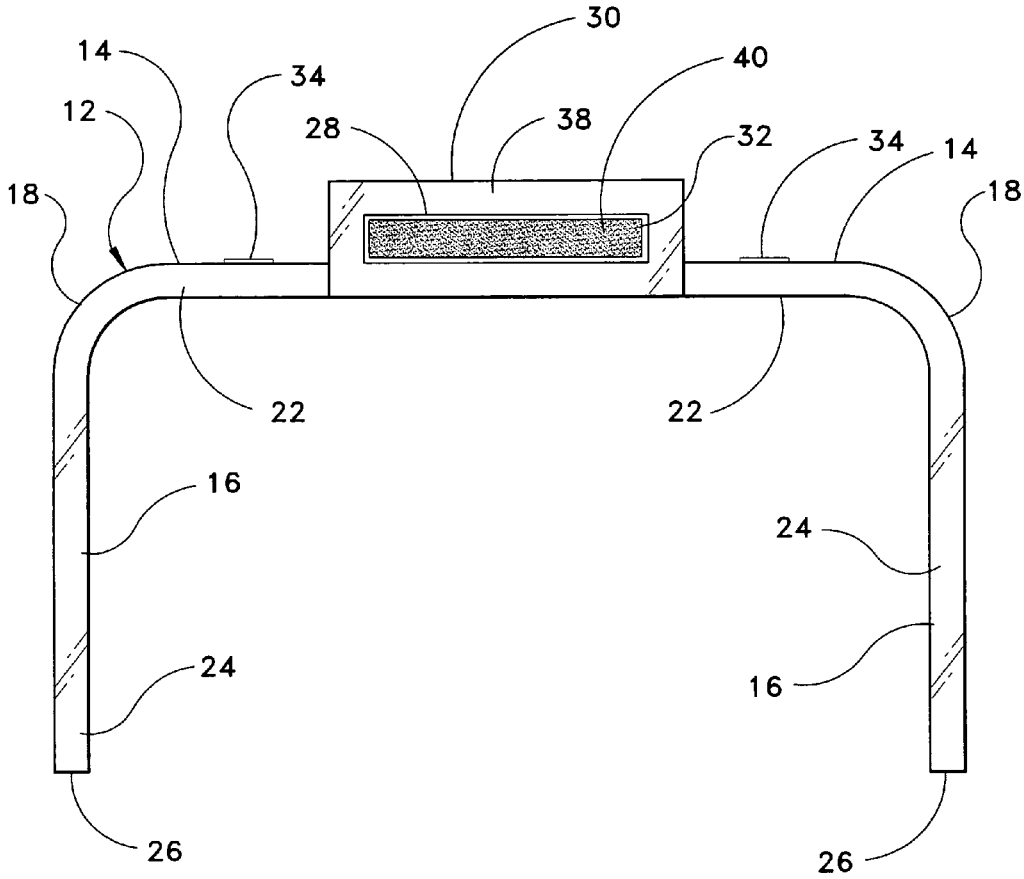
FIG. 2 is a rear elevation view of the golf training aid of FIG. 1.
Figure 3:
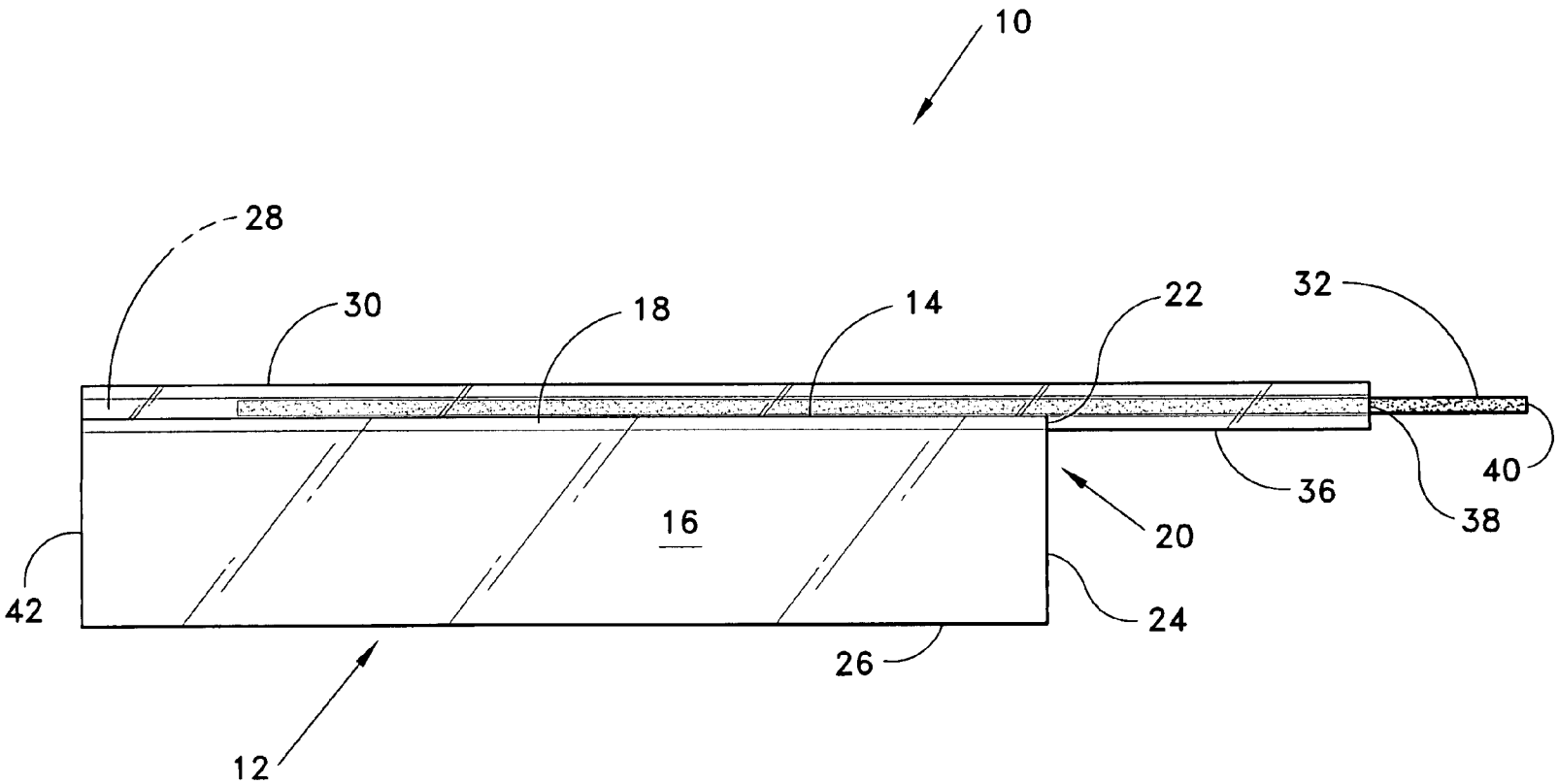
FIG. 3 is a side elevation view of the golf training aid of FIG. 1.

Referring to FIGS. 1–3, there is shown a perspective view, a rear end elevation view, and a side elevation view of the golf training aid 10, respectively. Training aid 10 includes a tunnel shaped body or housing 12 having an upper wall 14 and opposed sidewalls 16 connected with corner bends 18. Parallel sidewalls 16 support upper wall 14, the housing 12 being open at the base. Housing 12 has a generally rectangular entrance 20 formed by upper wall end portions 22 of housing upper wall 14 extending from slot housing 30 to entry upright end portions 24 formed by sidewalls 16. Housing 12 has a generally rectangular exit 42 identical to entrance 20.

A black or opaque strip of plastic forms an extendable guide bar 32 slidingly fitting within guide slot 30. The guide slot is formed by a rectilinear guide slot housing 32 centrally disposed along the length of the upper wall 14 and extending forward from the entrance opening 20, forming a neck 36. The extendable guide bar 32 is the same length as the guide slot housing 30, including the neck 36, and may be pulled forward a desired distance as determined by guide bar end 40 so as to lengthen the putt to be practiced with the training aid. The extendable guide bar 32 is about 1" in width, which is somewhat less that the diameter of a standard golf ball. The neck 36 extends forward from housing 10 to leading end 38, a distance sufficient for a putting stroke hitting ball B (see FIG. 4).

Figure 5:
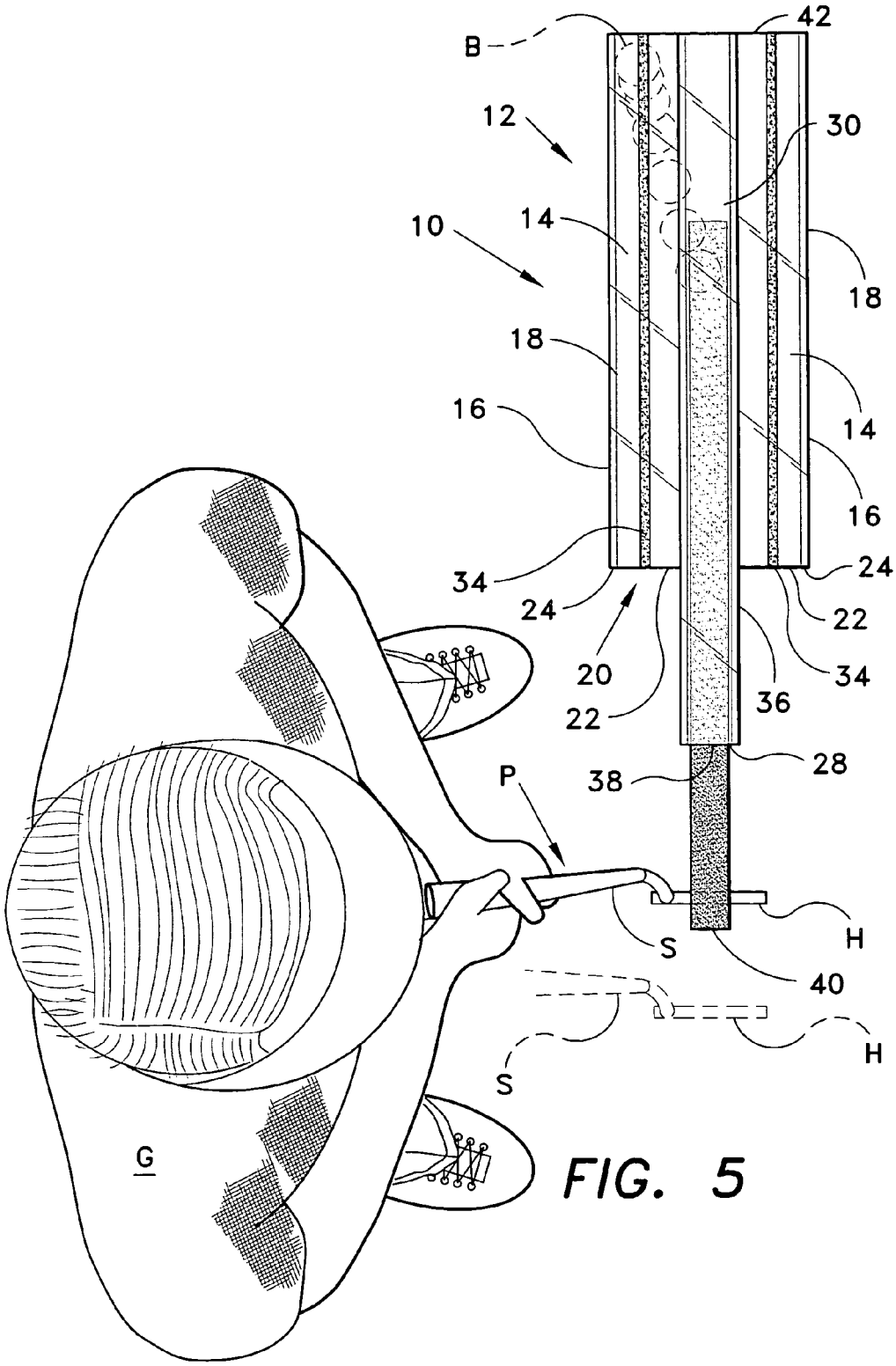
FIG. 5 is an environmental, plan view of the golf training aid of FIG. 1 in an extended position.

The extendable guide bar 32 within guide slot 28 may be pulled forward from neck leading end 38 to a desired location to extend the length of the target path for putting as desired (see FIG. 5). The extension bar 32 may then be returned to the retracted position within guide slot housing 30 for compact handling and storage.

The housing 12 has two parallel black or opaque stripes 34 extending along the full length of the upper wall 14, each stripe 34 being parallel to and equally spaced from a respective sidewall 16. The width between the parallel stripes is equal to the width of a conventional golf cup.

Figure 4:
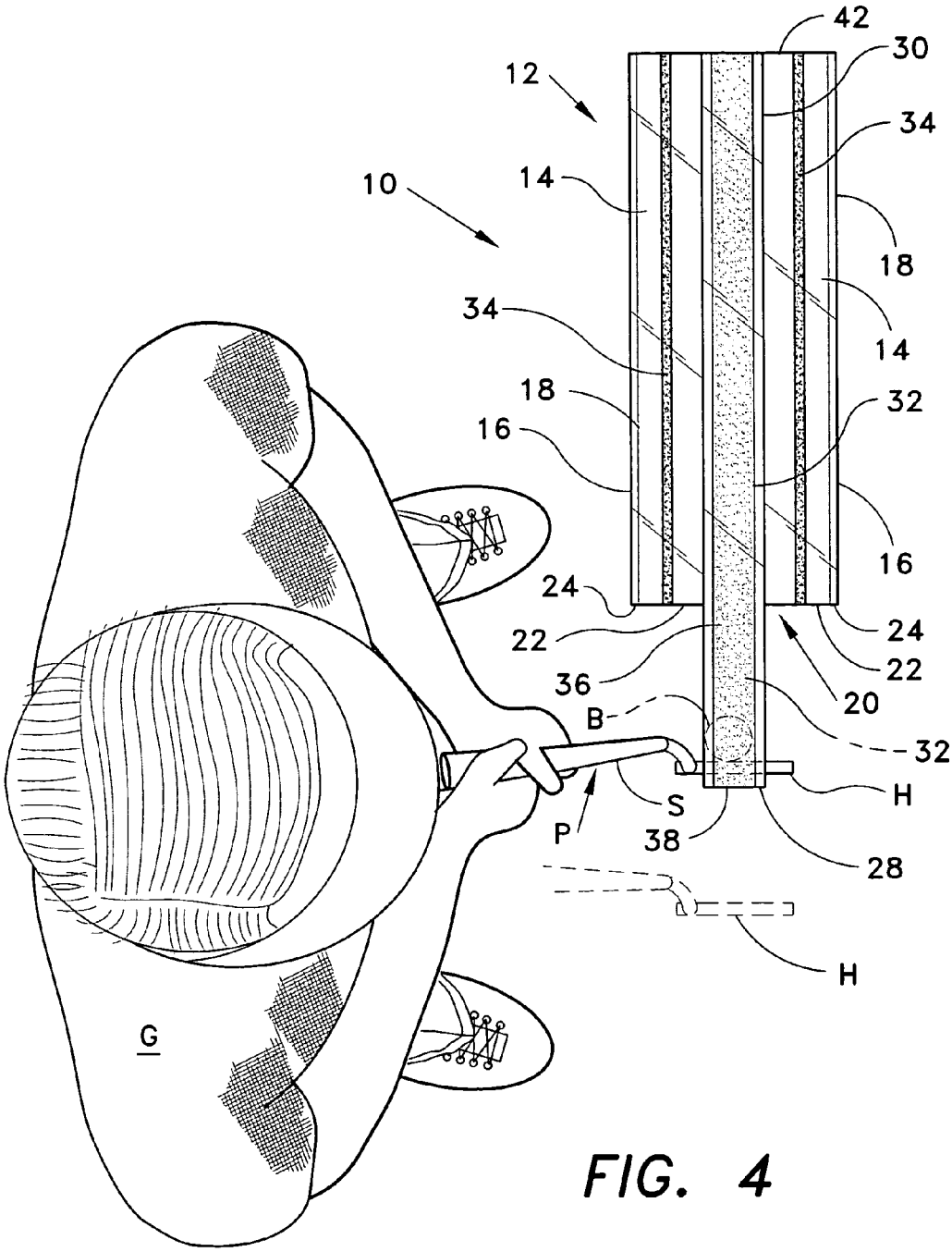
FIG. 4 is an environmental, plan view of the golf training aid of FIG. 1 in a retracted position.

FIG. 4 is an environmental plan view showing a golfer G in a putting stance over ball B which is in position under extendable guide bar 32 within neck 36 for putting with putter head H of putter P traveling through the putting stroke. It is noted that the outer edges of the ball B are visible to the golfer in this position. The black or opaque extendable guide bar allows the golfer G to observe the travel of the putter head H and his gripping hand relative thereto during the putting stroke to evaluate the stroke for straightness and squareness.

FIG. 5 is an environmental plan view similar to FIG. 4, showing a golfer G in a putting stance having stroked the ball B from a point under extendable guide bar 32 as extended from neck 36 (see FIG. 1) and illustrates the ball B traveling to the left of the extendable guide bar 32 and under stripe 34 within housing 12, indicating a defective stroke.

In use, the golf ball to be putted is placed directly beneath the extendable guide bar, either in the retracted or extended position as illustrated above. The golfer's body and feet are placed in alignment, and the putter face placed in a square position relative to the extendable guide bar. During the stroke, the putter head passes under the bar, showing the location of the golfer's gripping hand and the club head as related to the bar. In this manner, the golfer does not only get instant feedback as to the position of the club head in relation to the anticipated path, but also views the hand position relative thereto. One side of the ball becomes more visible if it deviates from the target path within the transparent body. If the ball crosses under either of the black or opaque stripes 14, this indicates that the ball would miss a golf cup (not shown).

The housing body is preferably formed from ¼" plastic having a height of about 3½" and an entrance and exit of about 6" in width between walls. The housing body has a walled length of about 18" with the neck extended forward about 6". The upper mounted guide bar slot housing has ¼" walls and extends ½" above the upper surface of the housing forming a guide bar slot to slidingly receive an extendable guide bar ¼" in thickness and 2' in length, with a width of about 1⅜". The extendable guide bar may be extended at least about 12" past the leading end of the neck, thus providing for a three-foot putt length.

Figure 6:
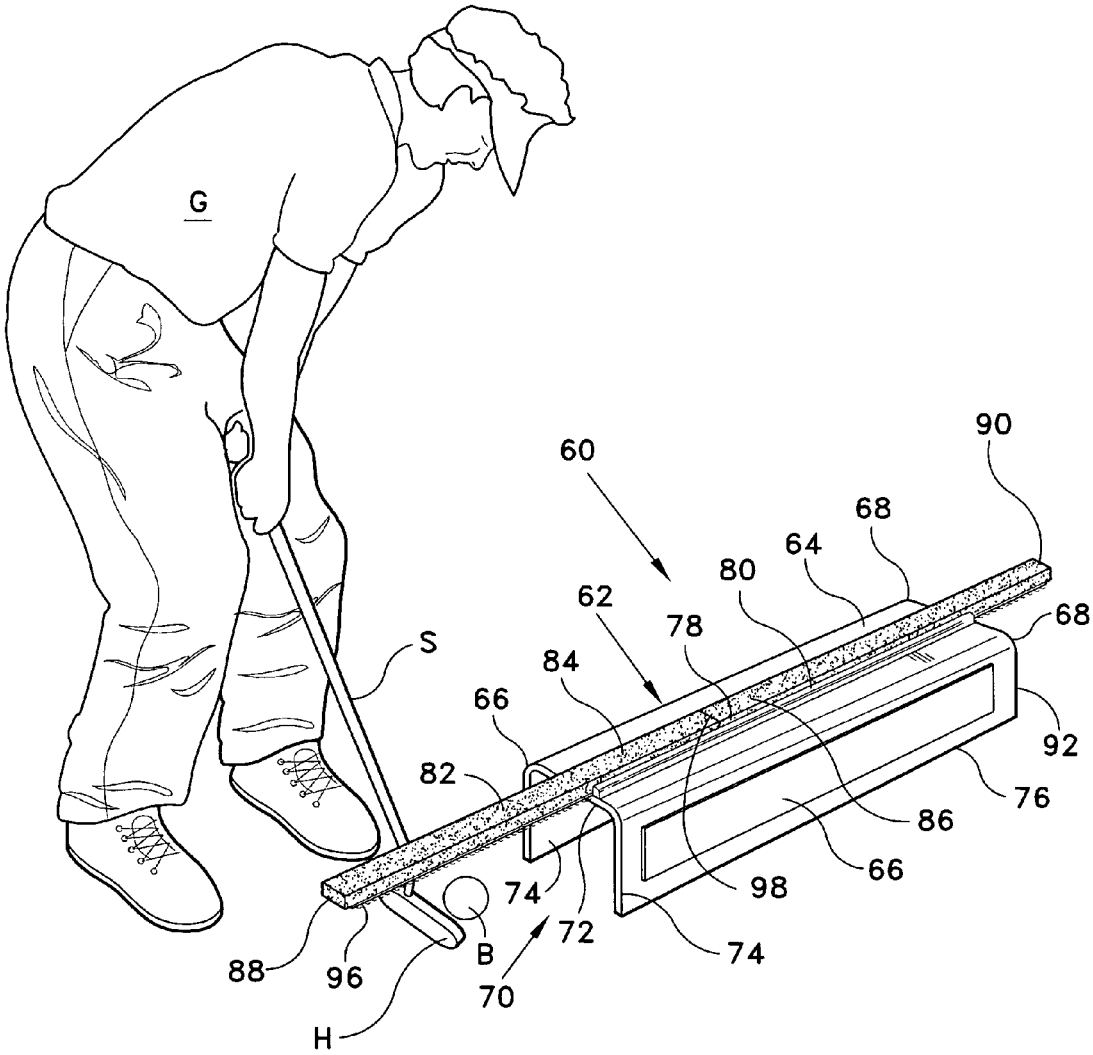
FIG. 6 is an environmental, perspective view of another embodiment of the invention similar to that of FIG. 1.

Referring to FIG. 6, there is shown an environmental perspective view of another embodiment of the golf training aid of the present invention referred to by the reference No. 60 herein as located on a grassy surface. A golfer G is shown addressing the ball B with a putter having a head H on a shaft S.

Figure 7:
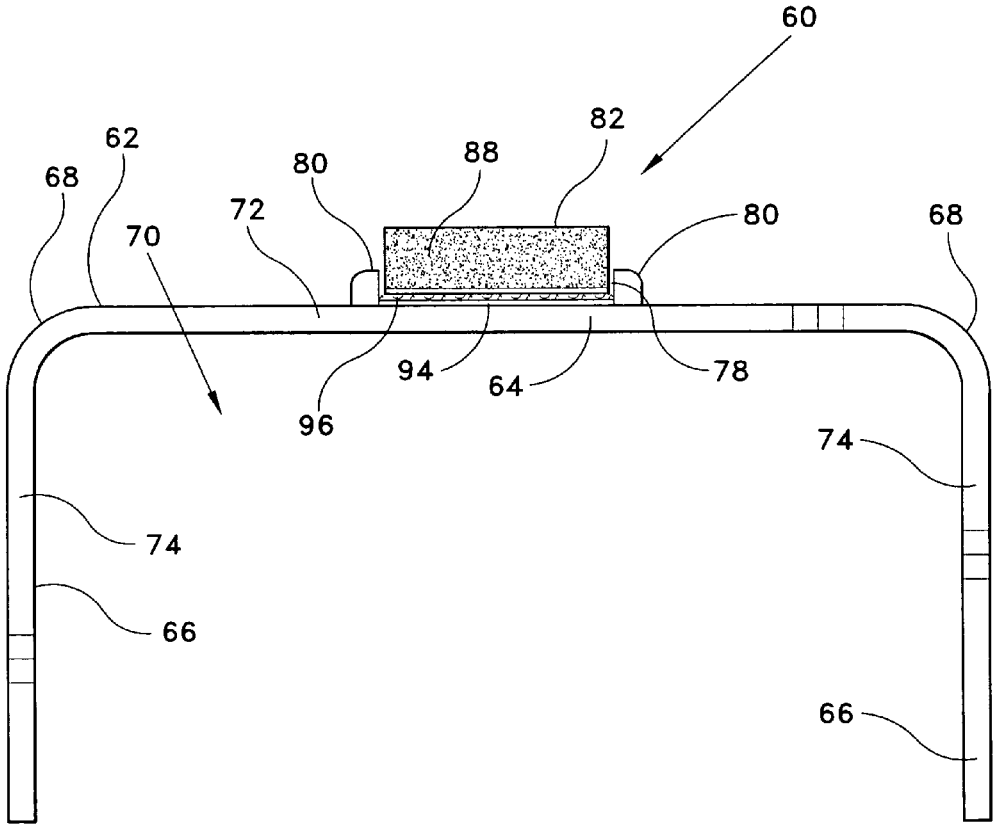
FIG. 7 is an end elevation view of the embodiment of FIG. 6.
Figure 8:
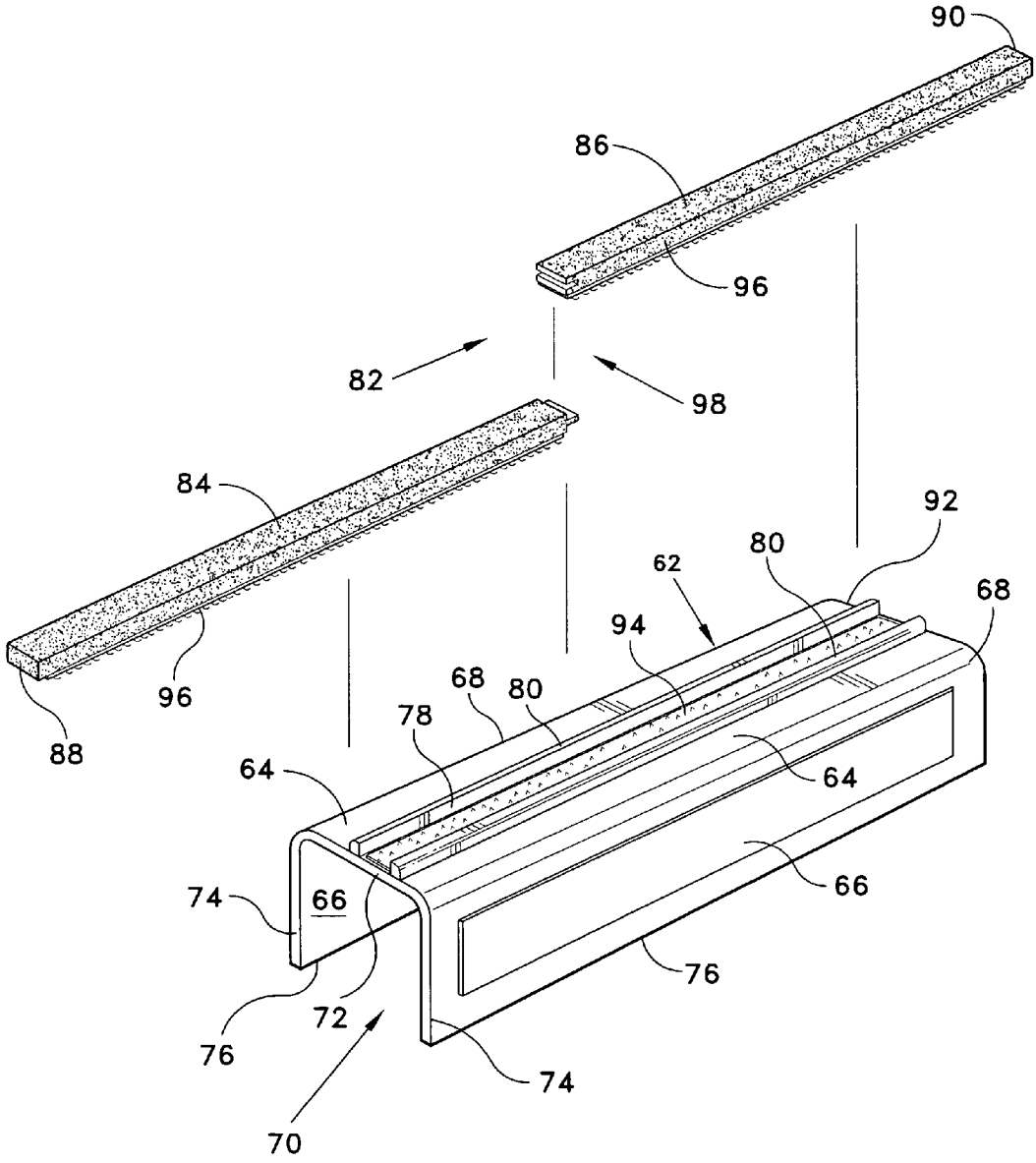
FIG. 8 is an exploded view of the embodiment of FIG. 6.

Referring to FIGS. 6–8, there is shown a perspective view, an end elevation view, and an exploded view of the golf training aid 60, respectively. Training aid 60 includes a tunnel shaped body or housing 62 having an upper wall 64 and opposed sidewalls 66 connected with corner bends 68. Parallel sidewalls 66 support upper wall 64, the housing 62 being open at the base. Housing 62 has a generally rectangular entrance 70 formed by housing entry end upper edge 72 and housing entry end upright portions 74 formed by sidewalls 76. Housing 62 has a generally rectangular exit end 92 identical to entrance 20.

Extendable guide bar 82 is a black or opaque strip of plastic fitting within open guide slot 78 formed along the central portion of the upper wall 64 of housing 62 by parallel slot side members 80 extending the length thereof. The open guide slot 78 may, alternatively, be formed by cutting the guide slot into the upper surface of the upper wall 64. Extendable guide bar 82 extends about twice the length of housing 62 and is preferably provided in two portions of equal length joined by a tongue and groove connection. Guide bar tongue portion 84 is joined to guide bar groove portion 86 by friction fit at tongue and groove joint 98 which is separable upon breaking down of training aid 60 for storage.

Slot 78 has loop material along its floor as formed by upper wall 64 and each of the guide bar tongue portion 84 and guide bar groove portion 86 has mating hook material (Velcro) on their undersides (see FIG. 8). The assembled guide bar 82 may be adjusted for desired putting length by separating the guide bar 82 from open guide slot 78 by pulling upward, separating the mated hook and loop material, moving the guide bar 82 to a new location relative to the length of housing 62, and placing the guide bar in open guide slot 78 where the hook and loop material mates, retaining guide bar 82 in place during use of golf training aide 60. This length adjustment allows for different practice strokes to be taken. Alternatively, the loop material may be on the guide bar 82 and the hook material in the open guide slot 78.

As an example, the housing 62 is of transparent material such as ¼-inch plastic forming a tunnel 3 TO 3½ inches tall and from 18 to 24 inches in length. The guide slot is 1 inch wide and, if cut into the housing upper wall, is from 1/16 to ⅛ inches deep. Each black plastic guide is ¼×1×18–24 inches in length and, together, have a 1½ inch overlapping tongue and groove connection. The golf training aide 60 is used for putting practice in a similar manner to that of golf training aide 10 described above.

It is to be understood that the present invention is not limited to the embodiments described above, but encompasses any and all embodiments within the scope of the following claims.

I claim:

1. A golf training aid, comprising:

a generally tunnel shaped body having an upper wall supported by opposed sidewalls forming an entry opening and an outlet opening;

said tunnel shaped body being of substantially transparent material;

said tunnel shaped body defining a guide slot centrally disposed in said upper wall and having a bottom wall and sidewalls, said guide slot extending along the length of said tunnel shaped body;

a substantially opaque elongate guide bar so sized and configured as to fit within said guide slot;

said guide bar extending at least the substantial length of said guide slot; and said guide bar defining a target path thereunder;

whereby a golf ball is placed below said guide bar in a position for putting; and whereby upon a golfer executing a putting stroke with a putter, the head of the putter, along with the gripping hands of the golfer, are observable by the golfer relative to said guide bar, any travel of the golf ball from the target path being readily observable within said transparent body.

2. The golf training aid of claim 1, said guide bar being of a width less than that of the diameter of a golf ball, whereby a golf ball placed directly below said guide bar in a position for putting is observable from above said guide bar.

3. The golf training aid of claim 2, wherein said guide slot is defined by parallel elongate slot side members mounted on said upper wall of said tunnel shaped body.

4. The golf training aid of claim 3, wherein said bottom wall of said guide slot is covered with one of hook and loop material and the lower wall of said guide bar is covered with the other of mating hook and loop material, whereby said guide bar may be lifted from one position in said guide slot and repositioned in another position in said guide slot to vary putting distance.

5. The golf training aid of claim 4, wherein said guide bar is divided into two parts along the length thereof and said two parts are frictionally attachable by an intermeshing tongue and groove joint, whereby said guide bar may be assembled for use and separated for storage.

6. The golf training aid of claim 5, wherein said guide bar is of a total length about twice the length of said tunnel shaped body.

7. A golf training aid, comprising:

a generally tunnel shaped body having an upper wall supported by opposed sidewalls forming an entry opening and an outlet opening;

said tunnel shaped body being of transparent material;

said tunnel shaped body defining a guide slot centrally disposed on said upper wall having a bottom wall and sidewalls, said guide slot extending along the length of said tunnel shaped body;

a substantially opaque elongate guide bar so sized and configured as to fit within said guide slot;

said guide bar extending at least the substantial length of said guide slot;

said guide bar defining a target path thereunder;

said guide bar being of a width less than that of the diameter of a golf ball;

said groove being defined by parallel elongate slot side members mounted on said upper wall of said tunnel shaped body; and said bottom wall of said slot being covered with one of hook and loop material and the lower wall of said guide bar being covered with the other of mating hook and loop material;

whereby a golf ball placed directly below said guide bar in a position for putting is observable from above said guide bar;

whereby upon a golfer executing a putting stroke with a putter, the head of the putter, along with the gripping hands of the golfer, are observable by the golfer relative to said guide bar, any travel of the golf ball from the target path being readily observable within said transparent body; and whereby said guide bar is lifted by a user from one position in said slot and repositioned in another position in said slot to vary putting distance.

8. The golf training aid of claim 7, further comprising:

a guide slot housing centrally disposed on said upper wall; said guide slot housing extending along the length of said tunnel shaped body and extending forward from said entrance opening forming a neck;

said guide slot housing defining a guide slot therethrough;

said black or substantially opaque extendable guide bar being so sized and configured as to slidingly fit within said guide slot;

said extendable guide bar extending the substantial length of said guide slot housing;

said extendable guide bar defining a target path thereunder;

said neck containing said extendable guide bar being of such length as to allow a putting stroke to be executed therebelow along said target path;

said guide bar being of a width less than that of the diameter of a golf ball;

whereby a golf ball is placed below said guide bar in a position such that each side of the golf ball may be observed from above said guide bar;

whereby upon a golfer executing a putting stroke with a putter, the head of the putter, along with the gripping hands of the golfer, are observable by the golfer relative to said guide bar, any travel of the golf ball from the target path being readily observable within said transparent body; and whereby a substantial deviation of the golf ball from the target path which would result in a missed putt is observable by the golf ball crossing under one of said black or opaque stripes.

9. The golf training aid of claim 7, said upper wall having a pair of spaced, parallel black or opaque strips extending along the length of said upper wall, said strips being spaced equally from respective said sidewalls and spaced a distance therebetween equal to the diameter of a golf cup.

* * * * *